US005772317A

United States Patent [19]

Butler

[11] Patent Number: 5,772,317

[45] Date of Patent: Jun. 30, 1998

[54] COUNTERFLOW DRUM MIXER FOR MAKING ASPHALTIC CONCRETE AND METHODS OF OPERATION

[75] Inventor: Theodore G. Butler, Orlando, Fla.

[73] Assignee: Gencor Industries, Inc., Orlando, Fla.

[21] Appl. No.: 703,780

[22] Filed: Aug. 27, 1996

[51] Int. Cl.[6] ..... B28C 5/46

[52] U.S. Cl. ..... 366/7; 366/25; 366/57

[58] Field of Search ..... 366/15, 22, 23, 366/24, 25, 54, 58, 57, 53, 144, 101, 105, 3, 7; 432/109, 111, 116, 118; 106/274, 284

[56] References Cited

U.S. PATENT DOCUMENTS

| | | | |
|---|---|---|---|
| 4,026,821 | 5/1977 | Schoofs et al. | 432/118 |
| 4,147,436 | 4/1979 | Garbelman et al. . | |
| 4,298,287 | 11/1981 | McCarter, III et al. . | |
| 4,332,478 | 6/1982 | Binz . | |
| 4,481,039 | 11/1984 | Mendenhall . | |
| 4,813,784 | 3/1989 | Musil . | |
| 4,919,538 | 4/1990 | Swisher, Jr. . | |
| 4,948,261 | 8/1990 | Marconnet | 366/25 |
| 4,988,207 | 1/1991 | Marconnet | 366/25 |
| 5,033,863 | 7/1991 | Linkletter | 366/25 |
| 5,040,973 | 8/1991 | Matter et al. | 432/118 |
| 5,203,693 | 4/1993 | Swanson . | |
| 5,261,738 | 11/1993 | Brock | 366/25 |
| 5,320,426 | 6/1994 | Keylon et al. | 366/25 |
| 5,480,226 | 1/1996 | Milstead | 366/25 |
| 5,558,432 | 9/1996 | Swisher, Jr. . | |

FOREIGN PATENT DOCUMENTS

| | | | |
|---|---|---|---|
| 3423521 | 1/1986 | Germany | 366/25 |
| 1609843 | 11/1990 | U.S.S.R. | 366/25 |

*Primary Examiner*—Tony G. Soohoo
*Attorney, Agent, or Firm*—Nixon & Vanderhye

[57] ABSTRACT

The counterflow drum mixer includes an elevated virgin aggregate inlet end and an opposite asphaltic product discharge end. A burner lies intermediate the ends and defines a combustion volume. Shield flights surround the combustion volume defining an annular chamber with the drum wall. Recycle material is supplied to the annular chamber at the upstream end of the combustion volume for heating by convection and conduction in the annular chamber. The virgin aggregate material flows through a drying zone, into the combustion volume and between the shield flights into the annular chamber for contact with and conductive heating of the recycle material. Radiant heat transfer from the combustion volume along radii of the drum to the annular chamber is prevented. Virgin aggregate and recycle material in the annular chamber is prevented from entering the combustion volume by the shape of the shield flights and the rotation of the drum which enables the virgin aggregate in the combustion volume to shield the recycle material from radiant heat. The combined virgin aggregate and recycle material is mixed with liquid asphalt in the mixing zone to form the asphaltic product.

18 Claims, 5 Drawing Sheets

Fig. 2
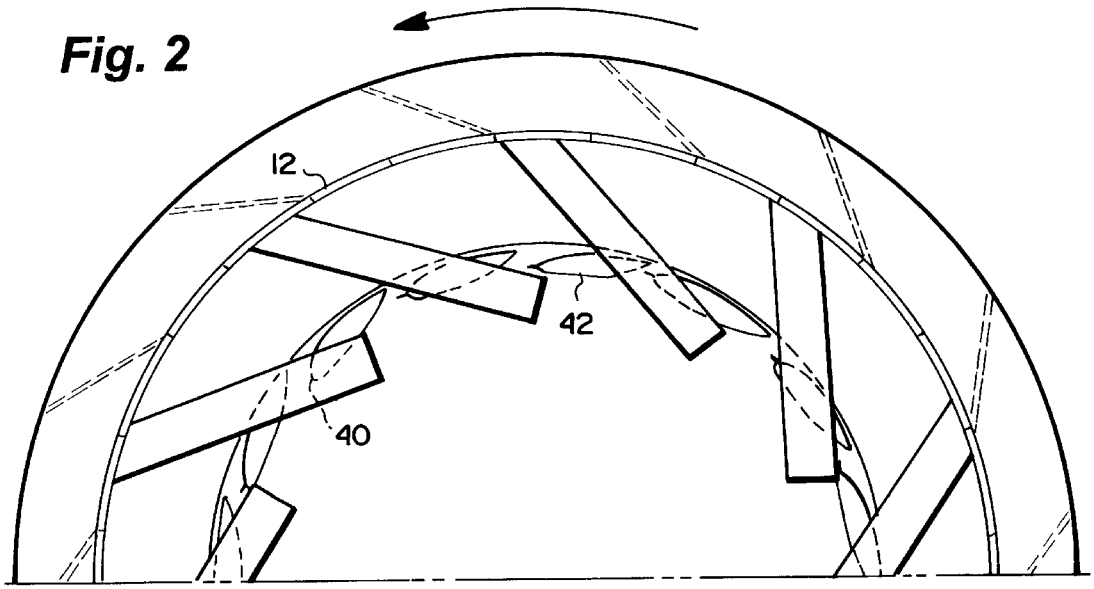
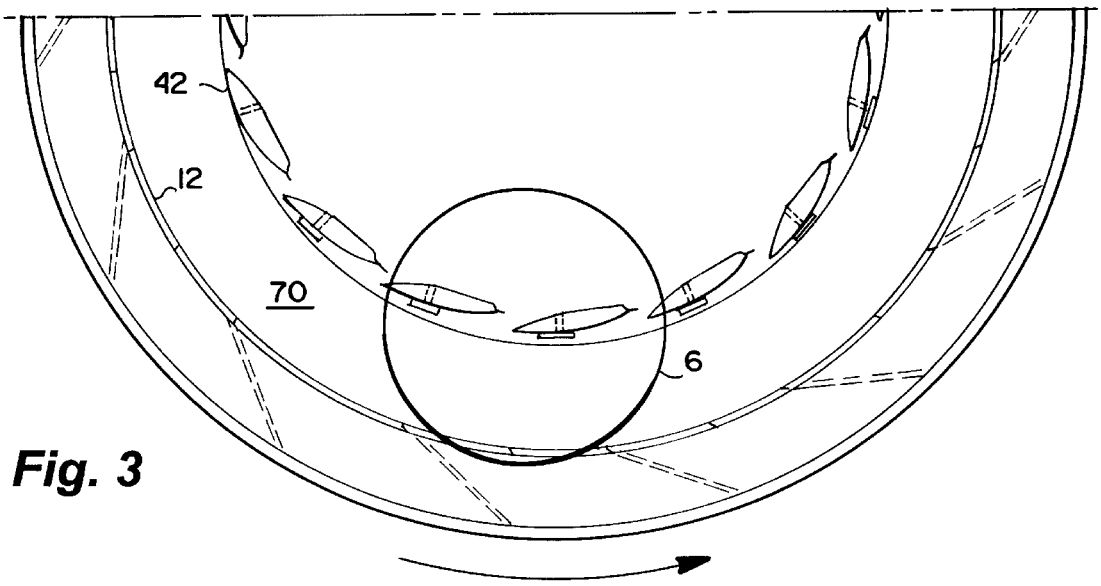
Fig. 3

COUNTERFLOW DRUM MIXER FOR MAKING ASPHALTIC CONCRETE AND METHODS OF OPERATION

BACKGROUND AND SUMMARY OF THE INVENTION

The present invention relates to a drum mixer for heating and drying aggregate and mixing the aggregate with liquid asphalt with or without recycled asphalt to form an asphaltic concrete product and particularly relates to a counterflow drum mixer for processing an increased percentage of recyclable asphaltic product and at higher moisture levels with substantial reductions in drum surface skin temperature and increased efficiencies.

Many and various types of drum mixers for making asphaltic concrete have been known, proposed and/or used in the past. One such drum mixer has an inclined drum rotatable about its axis, an inlet at its upper end and an asphaltic concrete product outlet at its lower end. A burner assembly extends through the breeching at the lower end of the drum and mounts a burner head spaced from the lower drum end to define a drying zone between the burner head and the aggregate inlet and an annular mixing zone between the burner head and the asphaltic concrete product outlet. Flighting is typically spaced circumferentially about and longitudinally along the interior wall of the drying zone of the drum to carry and veil aggregate input to the drum at its upper end. Hot gases of combustion from the burner flame flow in the drying zone countercurrently to the direction of flow of the aggregate through the drum, the hot gases flowing through the veiling aggregate to remove dust and moisture from the aggregate and exiting the drum for flow to a separator, e.g., a baghouse.

The mixing zone comprises an annular chamber between the burner tube assembly which projects into the drum from its lower end wall and the drum walls. A liquid asphalt pipe extends into the mixing chamber for discharging liquid asphalt onto the dried aggregate flowing into the mixing chamber whereby the dried aggregate and asphalt form asphaltic concrete.

Used or recycled asphaltic product and/or mineral filter, dust and/or additives may also be disposed in the drum for mixing in the mixing chamber with the hot dried aggregate whereby the final asphaltic concrete product comprises virgin aggregate, recycled asphaltic product and applied liquid asphalt. Drums of this type have been successfully used for many years in the asphalt industry. A recurring and constant problem whenever asphalt and hot gases or flame are used in conjunction with one another is "blue smoke" generated by the burning and/or volatilization of the asphalt. This causes environmental problems and it is therefore highly desirable to eliminate any production of blue smoke. This is a particular problem with the processing of recycle asphaltic material, and care must be taken to insulate the recycle material supplied to the drum from high temperatures and radiant heating by the flame. In such prior drum mixer as disclosed in U.S. Pat. No. 4,919,538, radiant heat is applied directly and purposefully to the recycle material. However, that design has been changed in practice to insulate the recycle material from radiant heat.

Further, recycle asphalt material often has a very high percentage of moisture requiring high temperatures to remove the moisture prior to mixing with asphalt. Failure to remove moisture from the recycle material enables the asphalt to be stripped from the product and forms unacceptable road covering material. In the above-referenced design, all of the energy for heating and drying the recycle material is supplied by the heated virgin aggregate material when mixed with the recycle material. Consequently, when the recycle material has a high moisture content, it typically requires a reduction in the percentage of recycle material added to the aggregate, or an increase in temperature to the virgin aggregate with higher steam loading or additional residence time for effective heat transfer from the heated virgin aggregate to the recycle material to remove the moisture and ensure complete drying of the material. Exposure of the recycle material to increased temperature is not a feasible alternative due to the blue smoke problem. An increase in residence time also requires a lengthening of the mixing zone of the drum for similar output or reduced output at higher cost. Higher temperatures tend to increase fuel costs rendering the final product uneconomical. Undesirable increases in drum skin temperature and consequent heat loses through the drum wall should also be avoided.

In accordance with the present invention, there is provided a novel and improved drum mixer for the production of asphaltic concrete which has the capability of not only heating and drying virgin aggregate and mixing the dried aggregate with liquid asphalt to provide an asphaltic concrete, but importantly, the capacity to process increased quantities of recycle material with higher moisture content with substantial improved efficiencies and without elevating the temperature of the drum mixer wall or decreasing throughput. To accomplish the foregoing, the present invention provides a counterflow drum mixer wherein virgin aggregate is supplied to an inlet at an elevated upper end of the drum, flows downstream to a location within a combustion volume and then to a drying and mixing zone, shielded from the radiant heat of the combustion volume where it mixes with recycle asphaltic material supplied to the drying and mixing zone. The combined virgin aggregate and recycle material then flows into a further mixing zone for mixing with liquid asphalt to form the final asphaltic concrete product dischargeable through an outlet at the downstream end of the drum. The upstream portion of the drying zone includes a plurality of veiling flights for lifting and veiling the virgin aggregate material through the hot gas stream generated by the burner head intermediate the drum ends and flowing counter-currently to the direction of flow of virgin aggregate.

The combustion volume is defined by the flame generated by the burner head and a plurality of shield flights are disposed about and surround the combustion volume. The shield flights are spaced from the outer wall of the drum to define an annular chamber between the shield flights and the drum wall. A recycle asphalt inlet collar is disposed about the drum at a location adjacent the upstream end of the combustion volume, the shield flights and annular chamber for receiving recycle asphalt into the annular chamber. Because the shield flights effectively form an interior wall of smaller diameter than the drum wall upstream of the annular chamber, the recycle material is shielded from line-of-sight radiant heat in a radial direction from the drum axis and substantially all other radiant heat from the flame of the combustion volume. Because of the smaller diameter of the annular chamber, lift flights are disposed at the juncture of the upstream portion of the drum and the annular chamber to lift the dried virgin aggregate onto the interior surfaces of the shield flights within the combustion volume. The shield flights, however, are circumferentially spaced and overlapped relative to one another to enable the virgin aggregate to flow between the flights into the annular chamber as the drum rotates thus combining with recycle material disposed in the annular chamber through the recycle material inlet. The spacing and configuration of the flights prevents radial inward flow of material from the annular chamber into the combustion volume once such material lies in the annular chamber. The spacing and configuration of the flights also provide a circumferential overlapping relation between adjacent flights preventing line-of-sight radiant heat in a radial direction from the axis of the combustion volume from entering the annular chamber. Consequently, the materials in the annular chamber, i.e., the recycle material and the virgin aggregate are heated by convection and conduction but not substantially by radiant heat from the combustion volume. This type of heat transfer not only prevents the temperature from exceeding a threshold temperature for generating blue smoke, but also heats the recycle material by convective and conductive processes in addition to direct contact heat transfer with the virgin aggregate.

Further, radiant heat from the combustion volume is prevented from directly heating the recycle material in the annular chamber by the overlying virgin aggregate. Particularly, the virgin aggregate flows along the interior surfaces of the shield flights in a generally axial direction within the combustion volume and, as the drum rotates, flows between the flights into the annular chamber. Because of the rotation of the drum, the materials in the annular chamber are located a like circumferential position about the drum as the virgin aggregate within the interior of the combustion volume. Hence, the virgin aggregate shields the combined materials in the annular chamber from the radiant heat of the combustion volume in addition to the blockage effected by the circumferential overlapping of the shield flights one with another. Also, the heat absorbed through conduction and convection by the materials in the annular chamber effectively reduces the skin temperature of the drum wall in that region of the drum mixer. Spiral flights are provided in the annular chamber to facilitate flow of the combined recycle asphalt and virgin aggregate in an axial direction toward the final mixing zone and to also afford mixing between the two materials. The combined materials in the annular chamber thus flow from the annular chamber into the mixing zone where they are combined with liquid asphalt to form a final asphaltic product.

In accordance with a preferred form of the present invention, there is provided a drum mixer for the production of asphaltic concrete comprising a drum rotatable about an axis, the drum having an inlet adjacent a first end of the drum for receiving aggregate for flow downstream along the drum toward a second end of the drum opposite the first end and an outlet adjacent the second end for discharging asphaltic concrete. A burner is disposed in the drum and has a burner head for generating a flame defining a combustion volume and located intermediate the first and second ends of the drum, the burner head dividing the drum into a drying zone between the burner head and the first end of the drum and a mixing zone between the burner head and the second end of the drum. The burner head generates hot combustion gases for flow upstream of the drum through the drying zone towards the first end of the drum in countercurrent flow relation to the flow of aggregate from the first end through the drying zone toward the second end of the drum for drying the aggregate. A plurality of radiant heat shield flights are carried by the drum and spaced inwardly of an interior circumferentially extending wall portion of the drum, the flights extending from a location within the drum adjacent the burner head generally axially towards the first end of the drum and circumferentially about the drum to surround the combustion volume interiorly of the flights and to define a substantially annular chamber between the flights and the interior wall portion of the drum. An inlet to the drum is located adjacent an upstream end of the plurality of flights for disposing recycle asphaltic material in the annular chamber, the flights being, spaced from one another circumferentially about the drum for flowing aggregate received within the combustion volume and along radially inner surfaces thereof from the upstream flow of aggregate generally radially outwardly between the flights and into the chamber for mixing with the recycle asphaltic material in the chamber while the flights substantially prevent return flow of the aggregate from the chamber into the combustion volume.

Accordingly, it is a primary object of the present invention to provide a novel and improved counterflow drum mixer for producing asphaltic concrete product with higher efficiencies and reduced heat loses, and particularly producing asphaltic concrete product from recycle and virgin aggregate wherein higher moisture content recycle asphaltic material can be combined with the virgin aggregate without reduced throughput or increased residence time.

BRIEF DESCRIPTION OF THE DRAWINGS

FIG. 2 is a fragmentary cross-sectional view taken generally about on line 2—2 in FIG. 1B;

FIG. 3 is a fragmentary cross-sectional view taken generally about on line 3—3 in FIG. 1B;

DETAILED DESCRIPTION OF THE DRAWINGS

Figure 1A:
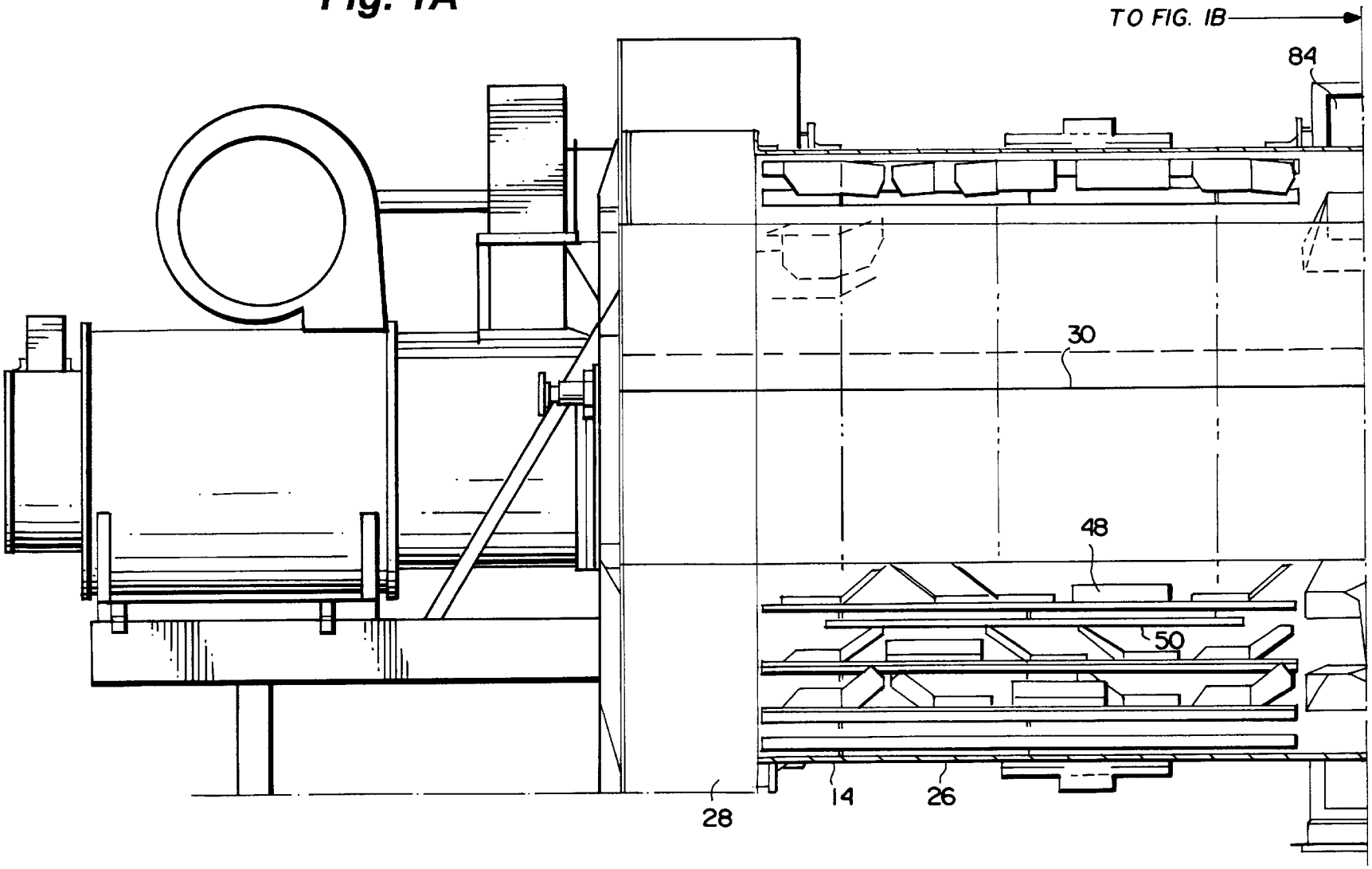
FIG. 1A and 1B combined as indicated are longitudinal cross-sectional views of a counterflow drum mixer constructed in accordance with the present invention with portions broken out and omitted for ease of illustration.
Figure 1B:
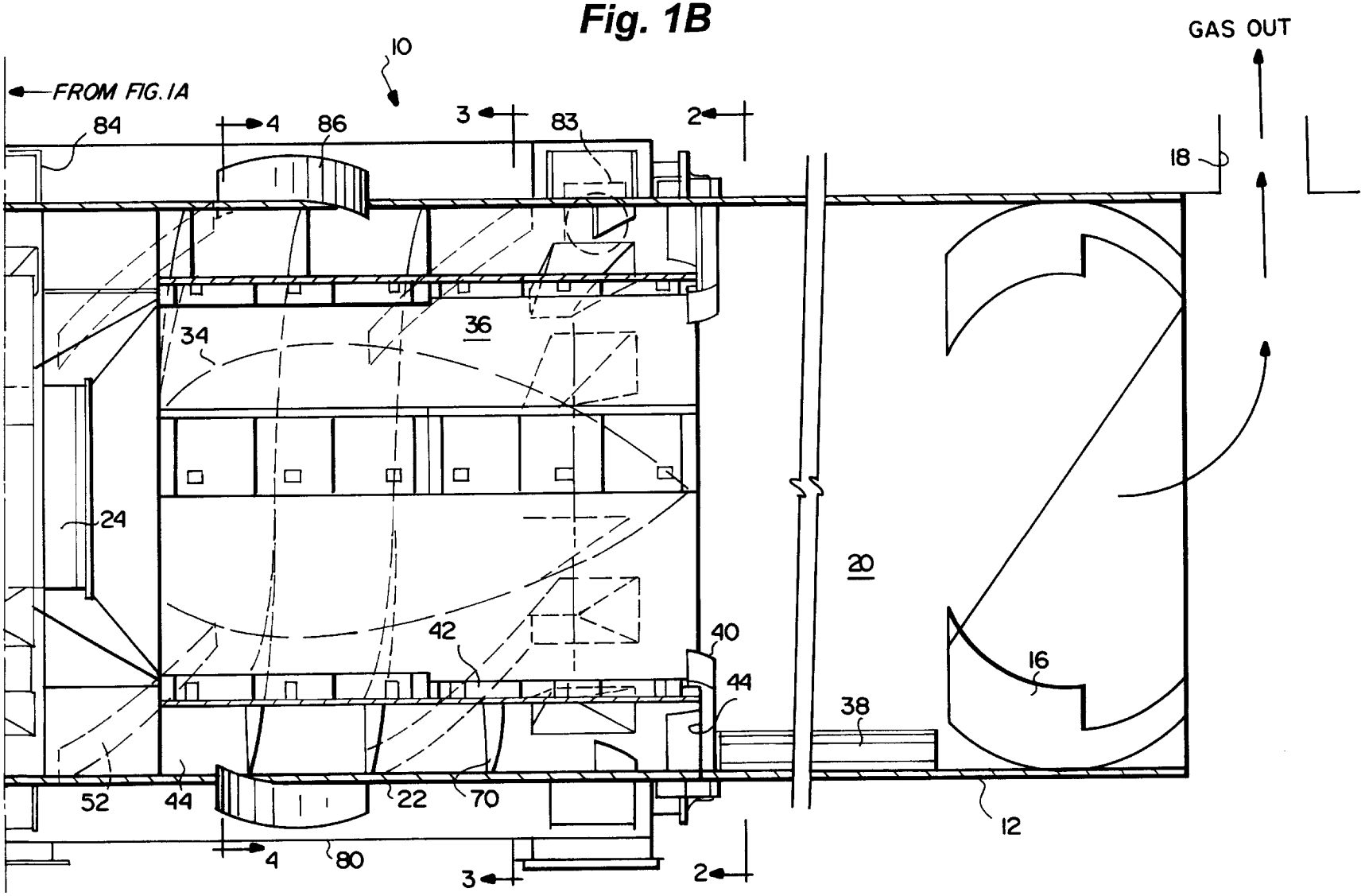

Referring now to the drawings, particularly FIGS. 1A and 1B, there is illustrated a counterflow drum mixer generally designated 10 and constructed in accordance with the present invention. The drum 10 is preferably inclined at a slight angle from the horizontal from end to end with the inlet end 12 being elevated above the outlet end 14. The inlet end has a plurality of spiral flights 16 for receiving virgin aggregate through the inlet end 12 and displacing the aggregate in a downstream direction toward the outlet end 14. The inlet end 12 also includes a hot combustion gas outlet 18 in communication with a separator, e.g., a baghouse (not shown) for separating particulate matter from the exhaust gases and exhausting clean exhaust air to the environment. Drum 10 is essentially divided into three zones, a first zone 20 for drying and heating the virgin aggregate passing along the drum toward the discharge end; a second mixing and drying zone 22 downstream of the drying zone 20 and upstream of a burner head 24 located intermediate the ends of the drum; and a third mixing zone 26 downstream of the burner head 24 for mixing aggregate with liquid asphalt to form a final asphaltic product. The first and second zones may be considered a drying zone because virgin aggregate is dried in the first zone and both virgin aggregate and recycle material are dried in the second zone.

A discharge outlet from the drum is generally indicated at 28. The burner head 24 is provided at the end of an elongated burner tube 30 which extends through the breeching at the downstream end of the drum and which is coupled to various fans, fuel and air supplies and other elements necessary for proper operation of the burner. As illustrated in FIG. 1B, the burner head 24 generates a flame indicated by the dashed lines 34 which extends a substantial axial distance and defines with shield flights, described below, a combustion volume 36.

In the drying zone 20, there is provided a plurality of axially and circumferentially spaced lifting flights 38. Flights 38 are designed to lift the virgin aggregate as the drum rotates and veil the aggregate across the drum through the hot gases flowing countercurrent to the flow of aggregate whereby the virgin aggregate is heated and dried in the drying zone 20. Spiral lifting flights 40 are provided at the juncture of the drying zone 20 and the combustion volume 36 to lift the virgin aggregate into the combustion volume defined in part by the shield flights 42. An annular wall 44 is disposed between the drying zone 20 and the combustion volume 36 preventing virgin aggregate from flowing directly into an annular chamber 44 between shield flights 42 of the drum wall as described below. In the mixing zone 26, there is also provided a plurality of circumferentially spaced axially extending mixing flights 48 for mixing aggregate in the mixing zone with liquid asphalt supplied thereto by an inlet pipe 50 for producing the asphaltic concrete. Pass-through flights 52 are disposed at the juncture of the mixing and drying zone 22 and the mixing zone 26 to ensure the material flows from the mixing and drying zone into the mixing zone.

Figure 4:
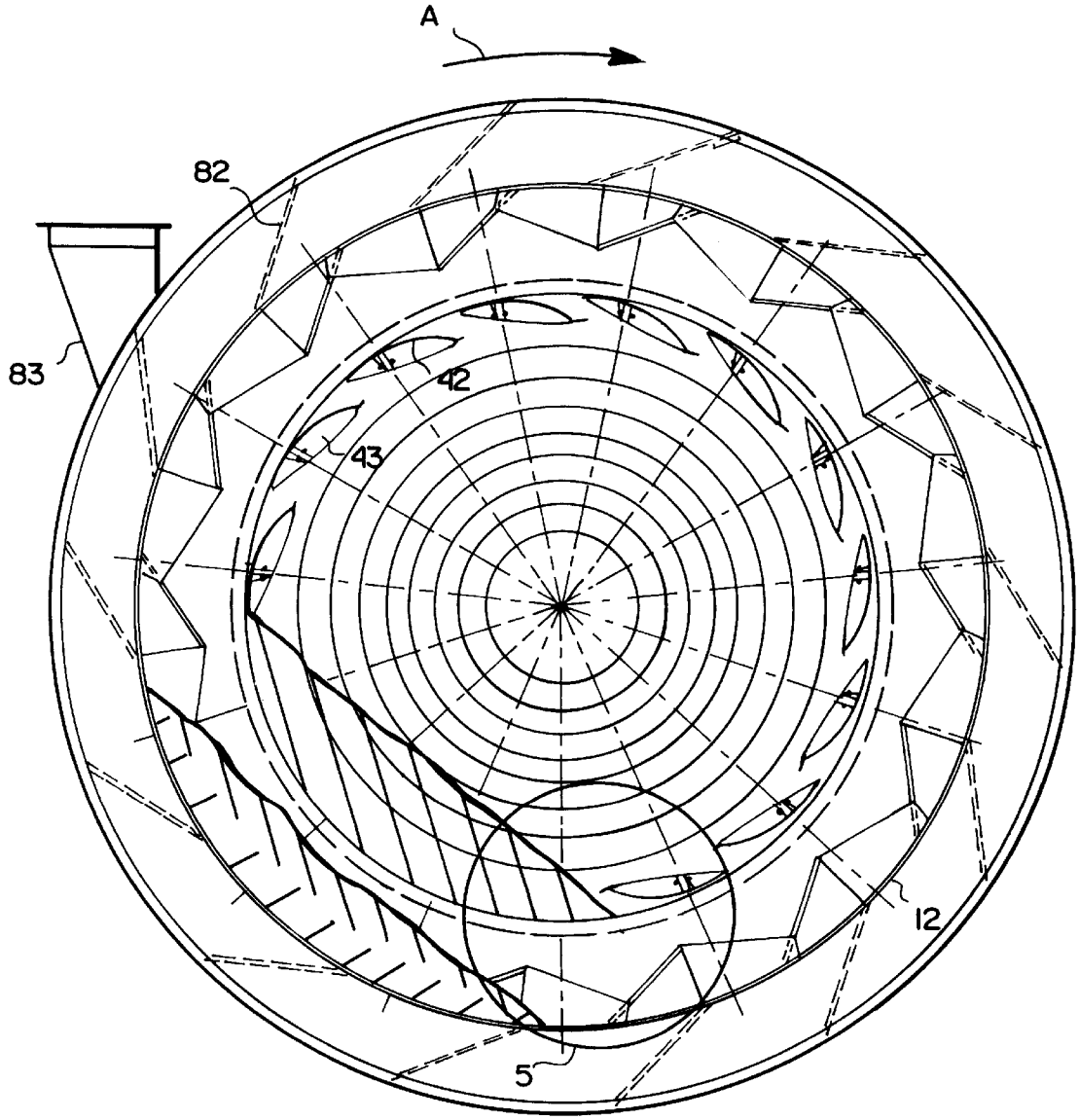
FIG. 4 is a cross-sectional view of the drum mixer of FIG. 1 taken generally about on line 4—4 in FIG. 1.
Figure 5:
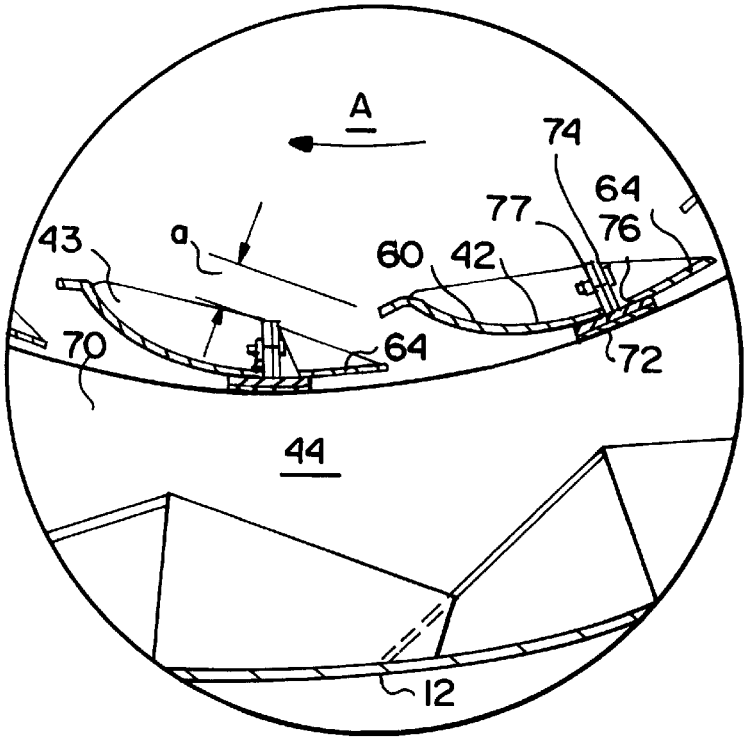
FIG. 5 is an enlarged cross-sectional view of a first embodiment of shield flights illustrating the radial and circumferential spacing of the flights one from the other.

An important aspect of the present invention relies in the configuration, spacing and function of the shield flights 42. As best illustrated in FIGS. 4 and 5, the shield flights 42 are spaced circumferentially one from the other about the circumference of the drum and spaced inwardly from the drum wall. Each shield flight 42 includes an arcuate surface 60 which extends in the axial direction of the drum and has its concave side facing the axis of the drum. Each shield flight 42 also includes axially spaced gussets 43 along the interior surfaces of the flights for reinforcing the flights. Each arcuate section 60 also includes a lip 62 which extends axially along the end of the shield flight 42 and forms a leading edge for the shield flight in the direction of rotation of the drum as indicated by the arrow A in FIG. 4. The trailing edge 64 of each of the shield flights 42 lies along a circumference having a larger diameter than the diameter of the circumference containing the lip 62. Additionally, the trailing edge 64 of each shield 42 underlies the leading lip 62 of an adjacent shield 42 such that the leading lip 62 overlaps the trailing edge 64 of adjacent shield flights 42. Stated differently, the lips 62 lie radially inwardly of and overlie the trailing edges 64 such that radial lines from the axis of the drum cannot pass through the juncture of adjacent flights without being intercepted by either the lip 62 or the trailing edge 64 or both. Preferably, the overlap is substantial to block direct line-of-sight radiant heat transfer from most portions of the combustion volume from entering the annular chamber. The flights 42 thus in essence form an annular shield between the material in the annular chamber 44 and the combustion volume 36.

Notwithstanding the overlapping relationship, there is a gap a between the lip 62 and trailing edge 64 of adjacent flights which defines an opening into the interior of the flights, i.e., the combustion volume 36 and outwardly into the annular chamber 44 between the shield flights 42 and the drum wall. As a consequence, the virgin aggregate material in the combustion volume advances both axially along the interior of shield flights 42 and outwardly through the openings into the annular chamber 44 as the drum rotates. Moreover, because of the unique configuration and spacing of the shields flights 42, the gap a permits flow of virgin aggregate from the combustion volume through the gap into the annular chamber 44 and prevents reverse flow of material from annular chamber 44 into the combustion volume 36.

Figure 6:
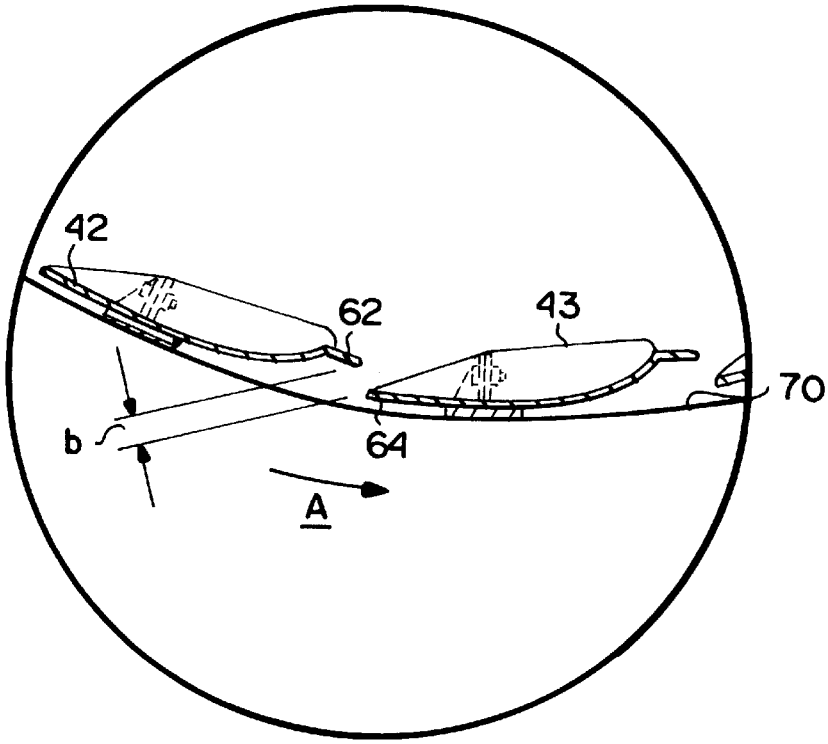
FIG. 6 is a view similar to FIG. 5 illustrating a further form of the spacing and configuration of the shield flights from one another.

The flights 42 may be provided in axially spaced sets of flights. As illustrated in a preferred embodiment, two sets of axially-spaced shield flights 42 are provided. The difference in the sets of flights resides in the different curvature of the flights resulting in a different gap between the lips and trailing edges. For example, in FIG. 6, there is illustrated a smaller gap b between the leading lip 62 and the trailing edge 64 of adjacent shield flights as compared with the gap a. The sets of flights are axially spaced from one another preferably with the shield flights having the smaller gap b between adjacent flights located axially upstream of the flights having the larger gap a. Consequently, the spacing between the shield flights varies between opposite ends of the combustion volume. In this manner, the virgin aggregate can progressively enter the area between the flights and into the annular chamber 44. The annular chamber 44 includes one or more helical or spiral flights 70 for driving the material downstream toward the mixing zone.

The shield flights 42 are secured to the spiral flight 70 in the annular chamber 44. Particularly, a short piece of flat stock 72 is secured, e.g., welded, to the inner edge of the spiral flight 70 at each point of securement, there being two or more points of securement for each shield flight 42. Each flat stock 72 also has a radial inward projection 74 having a bolt hole. Each shield flight 42 has an opening 76 at each point of securement for receiving the projection 74 and also a complementary radial inward projection 77 with a bolt hole for registry with the bolt hole of projection 74. By bolting the projections 74 and 77 to one another with projection 74 received through the opening, 76 and at each point of securement, it will be appreciated that the shield flights 42 are releasably secured within the drum surrounding the combustion volume and forming essentially an inner wall defining the outer annular chamber 44. A significant aspect of this arrangement is the capability of removing the flights 42 for access to the chamber 44 should it become necessary to clean out the chamber or replace flights 42.

For additional shielding from the radiant heat of the combustion volume, a further circumferential array of similar shield flights may be provided radially inwardly of the illustrated shield flights 42. These inner flights are similarly shaped and spaced as flights 42 and may be disposed such that medial portions thereof in the circumferential direction overlie the gaps a and b between flights 42. Lift flights may extend from the drying zone to lift virgin aggregate onto the inner flights for flow-through the gaps outwardly onto the outer shield flights 42 and thence through their gaps into the annular chamber. With this arrangement, line-of-sight radiant heat from the margins of the combustion volume is prevented from entering the annular chamber. The inner shields may be connected for support to the projections 74 by suitable brackets.

An outer sleeve 80 is also disposed about the drum in a fixed support structure (not shown). The sleeve 80 includes one or more inlet collars for receiving, recycle asphaltic and other materials. Recycle wheel blades 82 are mounted on the external portions of the drum wall for rotation therewith and have openings for receiving the recycle material from the inlet collars for passage into the annular chamber 44. A first inlet collar 83 lies at the extreme upstream end of the annular chamber, and a second inlet collar 84 lies at an axial location corresponding to the location of the burner head 24. Spiral flighting 86 is carried externally of the drum wall between collars 83 and 84 and the outer fixed wall of sleeve 80 such that any leakage of material past the first inlet collar 83 is conveyed downstream between the sleeve 80 and drum wall to the second inlet collar 84. Preferably the first inlet collar 83 is for receiving, recycle asphaltic material while the second inlet collar 84 is for receiving dust from the baghouse for combining into the first asphaltic products in the mixing zone.

In operation, the virgin aggregate is disposed through the inlet end 12 and transported downstream by the spiral flight 16. The veiling flights 38 veil the virgin aggregate across the interior of the drum through the hot gas stream generated by the burner head 24 for drying the virgin material. At the entrance to the combustion volume 36, the spiral flights 40 pass the heated virgin aggregate into the combustion volume for flow along the interior surfaces of the shield flights 42. As the drum rotates, the material passes through the gaps a and b of the shield flights and into the annular chamber 44, the material being unable to return into the combustion volume from the annular chamber 44 because of the shape of the shield flights and the rotation of the drum. Recycle asphaltic material is supplied to the first inlet collar and into the annular chamber 44. The virgin aggregate passing through the gaps a and b combines with the recycle asphaltic material in annular chamber 44 to heat the recycle material by direct contact with the virgin aggregate. Conduction and convection type heating from the combustion volume also heat the materials within the combustion volume. Spiral flighting 70 drives the combined virgin aggregate and recycle asphaltic material downstream toward the mixing chamber.

From a review of FIG. 4, it will be appreciated that not only is radiant heat prevented from heating annular chamber 44 by the overlapping nature of the shield flights 42, but the virgin aggregate within the combustion volume likewise shields the combined virgin aggregate and recycle asphaltic material in the annular chamber 44 from the radiant heat of the combustion volume. That is, the virgin aggregate inwardly of and on the shield flights blocks line-of-sight radiant heat transfer from the combustion volume to the combined recycle and virgin materials in chamber 44 as the drum rotates because both the virgin aggregate on the shields of the combined materials in chamber 44 lie at the circumferential positions about the drum during rotation. Further, this maintains the drum wall temperature lower than otherwise would be the case. Additionally, the wet recycle asphaltic material is held between the shield flights and the drum wall further insulating and protecting the drum wall from the high heat normal in a combustion volume. Still further, the highly-superheated virgin material is mixed with the recycle asphalt, and consequently, the virgin material quickly loses its heat to the recycle material, also reducing the potential for high drum wall temperatures. Thus, convective and conductive heat only is provided annular chamber 44 and radiant heat is prevented from reaching the materials in the annular chamber 44. The flights 52 facilitate the passage of the heated and dried material into the mixing zone. In the mixing zone, liquid asphalt is applied as necessary to form the final asphaltic concrete product.

The recycle asphaltic material is in essence preheated in the annular chamber 44 to temperatures below temperatures which would otherwise generate blue smoke while simultaneously moisture is being removed by such preheating, i.e., the contact with the virgin aggregate as well as the conductive and convection heating afforded from the combustion volume. Thus, a substantial portion of the moisture of the recycle material is driven off before the recycle material reaches mixing zone 26. The moisture passes through the gaps in the shield flights; for example, when the gaps between adjacent shield flights are located at rotary positions where there is no virgin aggregate on the shields as illustrated in FIG. 4. Consequently, the moisture and any residuals are driven off and into the combustion volume where any residual hydrocarbons are burned and pass with the hot gases of combustion to the baghouse.

Additionally, dust from the baghouse can be recycled into the second inlet collar for combination with the materials disposed in the mixing zone. While the dust entry may be effected from the discharge end of the drum, entry at the illustrated axial location is desirable for mixing the dust completely with the combined recycle and virgin aggregate to form part of the asphaltic product discharged from the drum. Additionally, the gaps between the shield flights enable a portion of the gases of combustion to flow between the gaps into the annular chamber 44. Because the pressure in the mixing zone can be maintained below the pressure in the drying zone, the hot bases can be pulled through the gaps to provide additional heating via convection heating in the annular chamber.

When using this invention, it has advantageously been found that recycle material with high moisture content can be disposed in the drum for combination with the virgin aggregate. For example, it has been found that the final product can be composed of 50% recycle material and that the recycle material may have up to an initial 5% moisture content. Previously similar quantities of recycle material with moisture levels higher than 2–2.5% could not be adequately dried without reducing the quantity of the recycle material being processed. It will be appreciated that if the moisture remains on the recycle material in the mixing zone, the moisture will strip the asphalt from the aggregate, hence leading to a faulty asphaltic product. Thus, the present invention enables heating and drying of large quantities of recycle material with high moisture content up to about 5%.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A drum mixer for the production of asphaltic concrete, comprising:

a drum rotatable about an axis, said drum having a first inlet adjacent a first end of said drum for receiving aggregate for flow downstream along the drum toward a second end of the drum opposite said first end and an outlet adjacent said second end for discharging asphaltic concrete;

a burner disposed in said drum and having a burner head for generating a flame defining a combustion volume and located intermediate said first and second ends of said drum, said burner head dividing the drum into a drying zone between said burner head and said first end of said drum and a mixing zone between said burner head and said second end of said drum, said burner head generating hot combustion gases for flow upstream of said drum through said drying zone towards said first end of the drum in countercurrent flow relation to the flow of aggregate from said first end through said drying zone toward said second end of the drum for drying the aggregate;

a plurality of radiant heat shield flights carried by said drum and spaced inwardly of an interior circumferentially extending wall portion of said drum, said flights extending from a location within said drum adjacent said burner head generally axially towards said first end of said drum and circumferentially spaced about said drum to surround said combustion volume interiorly of said flights to define a substantially circumferentially continuous annular chamber between said flights and said interior wall portion of said drum; and a second inlet to said drum located adjacent an upstream end of said plurality of shield flights for disposing recycle asphaltic material in the annular chamber, said flights being spaced from one another circumferentially about said drum for flowing aggregate received within said combustion volume and along radially inner surfaces thereof from the upstream flow of aggregate generally radially outwardly between said flights and into said chamber for mixing with the recycle asphaltic material in said annular chamber while said flights substantially prevent return flow of the aggregate from said annular chamber into said combustion volume.

2. A drum mixer according to claim 1 wherein each said flight has an edge spaced from a circumferentially adjacent flight and overlapping said adjacent flight such that said edges substantially preclude radiant heat transfer from the combustion volume into said chamber along radii extending from said axis towards said annular chamber and to the recycle asphaltic material and virgin aggregate within said annular chamber.

3. A drum mixer according to claim 1 wherein each flight includes an elongated element having a concave side facing said combustion volume.

4. A drum mixer according to claim 1 wherein each flight includes an elongated element having an opening therethrough and a bracket connected to said drum and passing through said opening for securing said flight to said drum.

5. A drum mixer according to claim 1 wherein said flights are disposed in an axial direction along said drum and include first and second sets of flights axially spaced from one another, the spacing between the circumferentially-spaced flights of said first set thereof being different than the spacing between the circumferentially spaced flights of said second set thereof.

6. A drum mixer according to claim 1 including a third material inlet downstream of said second recycle material inlet at an axial location adjacent said burner head for supplying material to the mixing zone, a generally-cylindrical shell about and disposed outwardly of said drum between said second and third inlets, and flights between said drum and said shell for advancing a portion of the recycle asphaltic material from the second inlet to the third inlet.

7. A drum mixer according to claim 1 wherein said flights are releasably secured to the drum.

8. A method for making asphaltic concrete comprising the steps of:

introducing aggregate adjacent a first end of a drum mixer for flow toward a second, opposite end of said drum mixer;

locating a burner head within said drum mixer intermediate said drum ends and defining a drying zone for the aggregate between said burner head and said first end of said drum mixer and a mixing zone between said burner head and said second end of said drum mixer;

providing a plurality of flights circumferentially spaced from one another, extending axially towards said first end of said drum from adjacent said burner head and surrounding a combustion volume generated by said burner head, said flights defining a substantially circumferentially continuous annular chamber between said flights and an interior wall portion of said drum mixer and about said combustion volume;

generating hot gases of combustion in said combustion volume for flow through said drying zone countercurrently to the flow of aggregate through said drum mixer;

flowing the aggregate into the combustion volume onto the flights whereby the aggregate lies radially inwardly of the flights;

flowing the aggregate in the combustion volume lying radially inwardly of and on the flights through spaces between said circumferentially spaced flights into said annular chamber; and introducing recycle asphaltic material into said annular chamber adjacent an upstream end thereof for mixing and lying in heat transfer relation with the aggregate flowing into the annular chamber from said combustion volume through said spaces whereby the recycle material is heated prior to introducing the aggregate and recycle material into the mixing zone.

9. A method according to claim 8 including introducing dust into the mixing zone at a location adjacent the burner head for mixing with the recycle asphaltic material and the aggregate.

10. A method according to claim 8 including varying the flow of aggregate through the spaces between the circumferentially spaced flights into the annular chamber at different axial locations along said drum.

11. A method according to claim 8 including rotating the drum about a longitudinal axis thereof, and overlapping leading and trailing edges of said flights in the direction of rotation to preclude radiant heat transfer from the combustion volume into the annular chamber along radii from the axis of the drum.

12. A method according to claim 8 including removably mounting the shield flights from the drum to enable access to the annular chamber.

13. A drum mixer for the production of asphaltic concrete, comprising:

a drum rotatable about an axis, said drum having a first inlet adjacent a first end of said drum for receiving aggregate for flow downstream along the drum toward a second end of the drum opposite said first end and an outlet adjacent said second end for discharging asphaltic concrete;

a burner disposed in said drum and having a burner head for generating a flame defining a combustion volume and located intermediate said first and second ends of said drum, said burner head dividing the drum into a drying zone between said burner head and said first end of said drum and a mixing zone between said burner head and said second end of said drum, said burner head generating hot combustion gases for flow upstream of said drum through said drying zone towards said first end of the drum in countercurrent flow relation to the flow of aggregate from said first end through said drying zone toward said second end of the drum for drying the aggregate;

a plurality of radiant heat shield flights carried by said drum and spaced inwardly of an interior circumferentially extending wall portion of said drum, said flights extending from a location within said drum adjacent said burner head generally axially towards said first end of said drum and circumferentially spaced about said drum to surround said combustion volume interiorly of said flights to define a substantially annular chamber between said flights and said interior wall portion of said drum; and a second inlet to said drum located adjacent an upstream end of said plurality of flights for disposing recycle asphaltic material in the annular chamber, said flights being spaced from one another circumferentially about said drum for flowing aggregate received within said combustion volume and along radially inner surfaces thereof from the upstream flow of aggregate generally radially outwardly between said flights and into said chamber for mixing with the recycle asphaltic material in said chamber while said flights substantially prevent return flow of the aggregate from said chamber into said combustion volume;

said annular chamber including at least one generally helically-extending blade for conveying the aggregate and the recycle aggregate material in the combustion volume towards said mixing zone.

14. A drum mixer according to claim 13 wherein each said flight has an edge spaced from a circumferentially adjacent flight and overlapping said adjacent flight such that said edges substantially preclude radiant heat transfer from the combustion volume into said chamber along radii extending from said axis towards said annular chamber and to the recycle asphaltic material and virgin aggregate within said annular chamber.

15. A drum mixer according to claim 13 wherein each flight includes an elongated element having a concave side facing said combustion volume.

16. A drum mixer according to claim 13 wherein each flight includes an elongated element having an opening therethrough and a bracket connected to said blade and passing through said opening for securing said flight to said drum.

17. A drum mixer according to claim 13 wherein said flights are disposed in an axial direction along said drum and include first and second sets of flights axially spaced from one another, the spacing between the circumferentially-spaced flights of said first set thereof being different than the spacing between the circumferentially spaced flights of said second set thereof.

18. A drum mixer according to claim 13 including a third material inlet downstream of said second recycle material inlet at an axial location adjacent said burner head for supplying material to the mixing zone, a generally-cylindrical shell about and disposed outwardly of said drum between said second and third inlets, and flights between said drum and said shell for advancing a portion of the recycle asphaltic material from the second inlet toward the third inlet.

* * * * *

UNITED STATES PATENT AND TRADEMARK OFFICE

CERTIFICATE OF CORRECTION

PATENT NO. : 5.772,317
DATED : June 30, 1998
INVENTOR(S) : Theodore G. Butler

It is certified that error appears in the above-identified patent and that said Letters Patent is hereby corrected as shown below:

On the title page, item [56] Foreign Patent Or Published Foreign Patent Application insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 0 | 5 | 4 | 9 | 3 | 1 | 10/1991 | FARNHAM ET AL | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 3 | 4 | 0 | 4 | 6 | 2 | 11/08/89 | EPO | | | | |
| | | | | | | | | | | | | | | |

Signed and Sealed this

Ninth Day of February, 1999

*Attest:*

*Attesting Officer*

*Acting Commissioner of Patents and Trademarks*